United States Patent [19]

Bassett et al.

[11] Patent Number: 4,777,860

[45] Date of Patent: Oct. 18, 1988

[54] BRAIDING NOSE

[75] Inventors: Clarence W. Bassett, Hohenwald; Francis R. McGranaghan, Nashville, both of Tenn.

[73] Assignee: Dana Corporation, Toledo, Ohio

[21] Appl. No.: 69,889

[22] Filed: Jul. 6, 1987

[51] Int. Cl.[4] ..... D04C 3/40; D04C 3/48; B29C 53/82

[52] U.S. Cl. ..... 87/29; 87/34; 87/35; 156/148; 156/393

[58] Field of Search ..... 87/29, 6, 33–35; 156/148, 172, 149, 393; 138/123–127

[56] References Cited

U.S. PATENT DOCUMENTS

| | | | |
|---|---|---|---|
| 173,616 | 2/1876 | Gillespie | 87/29 X |
| 864,168 | 8/1907 | Hinsky | 87/23 X |
| 1,418,521 | 6/1922 | Turck et al. | 87/34 |
| 1,693,630 | 12/1928 | Wermine | 138/124 |
| 1,913,292 | 6/1933 | Schweiter | 87/29 |
| 1,968,240 | 7/1934 | Bardsley | 87/29 |
| 1,997,211 | 4/1935 | Ford et al. | 87/29 X |
| 2,918,777 | 12/1959 | Reeve et al. | 87/34 X |
| 3,099,932 | 8/1963 | Ege et al. | 87/35 X |
| 3,457,962 | 7/1969 | Shobert | 138/144 |
| 3,639,187 | 2/1972 | Poltorak | 156/149 |
| 4,194,942 | 3/1980 | Tanaka | 156/433 |
| 4,202,718 | 5/1980 | Mizutani et al. | 156/171 |
| 4,326,905 | 4/1982 | Tanaka | 156/149 |
| 4,490,316 | 12/1984 | Satzler | 156/393 X |
| 4,501,629 | 2/1985 | Satzler | 156/149 |
| 4,517,039 | 5/1985 | Satzler | 156/149 |
| 4,519,290 | 5/1985 | Inman et al. | 87/34 X |

*Primary Examiner*—John Petrakes

*Attorney, Agent, or Firm*—Marshall & Melhorn

[57] ABSTRACT

A braiding nose for use in forming a braided cover for hydraulic hose includes a right frustum portion connected between a larger diameter cylindrical portion and a smaller diameter tip portion. A central aperture is formed in the braiding nose for the passage of a flexible tube and means are provided for attaching the braiding nose to a braiding machine. Strands of wire are directed over the outer surface of the right frustum portion and the tip portion, which portions function to absorb the braiding forces which would otherwise tend to deform or collapse the flexible tube as the strands are braided together.

18 Claims, 1 Drawing Sheet

BRAIDING NOSE

BACKGROUND OF THE INVENTION

This invention relates generally to an improvement in the manufacture of braided, reinforced hose, and more particularly to a braiding nose for forming a braided layer on the exterior of a flexible hose.

Commercially available hydraulic high pressure hoses are typically manufactured by extruding an elastomeric material to form a tube having the desired interior diameter and wall thickness. A braid is then applied to the exterior of the tube by a maypole type braider which utilizes a plurality of carriers to supply strands of wire, typically brass plated high tensil steel wire.

In order to form a uniform braid, the wire must be maintained under tension which exerts forces on the exterior of the tube. The braiding forces tend to distort and collapse the tube during the manufacturing process. In order to resist the braiding forces, the tube is typically frozen with liquid nitrogen prior to the braiding process. The tube to be braided is pulled through a cooling tube with a controlled flow of liquid nitrogen which freezes and hardens the uncured elastomer and provides a hard surface which will resist deformation during braiding. The braided hose is then crossheaded on an extruder and the cover applied. The hose is covered in a lead or thermoplastic sheath and cured in an autoclave with high pressure steam.

The prior art braiding machines include a mandrel on which the braided reinforcement is formed. The mandrel extends through a guide ring. A plurality of elongated strands of metallic wire are drawn from a plurality of bobbins carried on rotating spindles on the braiding machine and are directed in a predetermined pattern across the guide ring and onto the mandrel. Half of the bobbins are rotating in an opposite direction relative to the other half so that the strands of wire are spirally wrapped on the mandrel in an alternating overlapping interwoven relationship to continuously produce the braided tubular member. The strands are positioned in abutting relationship with one another to form a close knit braid which has a total initial coverage on the mandrel with no openings therebetween. As the braid is formed, it is drawn off the end of the mandrel and onto the outer surface of an elastomeric tube which is being drawn through the center of the hollow mandrel.

SUMMARY OF THE INVENTION

The present invention concerns a braiding nose for applying a braided wire to the exterior surface of a flexible tube. The braiding nose has a cylindrical body portion, a right frustum portion extending from the body portion and a tapered tip extending from the right frustum portion. An aperture is formed coaxial with the axis of the cylindrical body and the tube to be braided is drawn through the aperture from the body portion to the tip portion. A plurality of strands of wires are fed from adjacent spools and are guided by the right frustum portion to the tip portion where they are formed into a braided exterior cover for the tube.

The tip portion absorbs most of the braiding forces before the braided wires slip onto the tube passing through the aperture. Thus, the tube does not require freezing or any other form of support during the braiding process, less scrap is produced, and the final product has as high or higher quality as hose manufactured by the prior art process. The angle of the taper for both the right frustum portion and the tip portion can vary within predetermined ranges in accordance with the outer diameter of the tube. The length of the tip portion is relatively short as compared with prior art mandrels and is at least as long as the width of the wire plat at the braiding angle.

DETAILED DESCRIPTION OF THE PREFERRED EMBODIMENT

Figure 1:
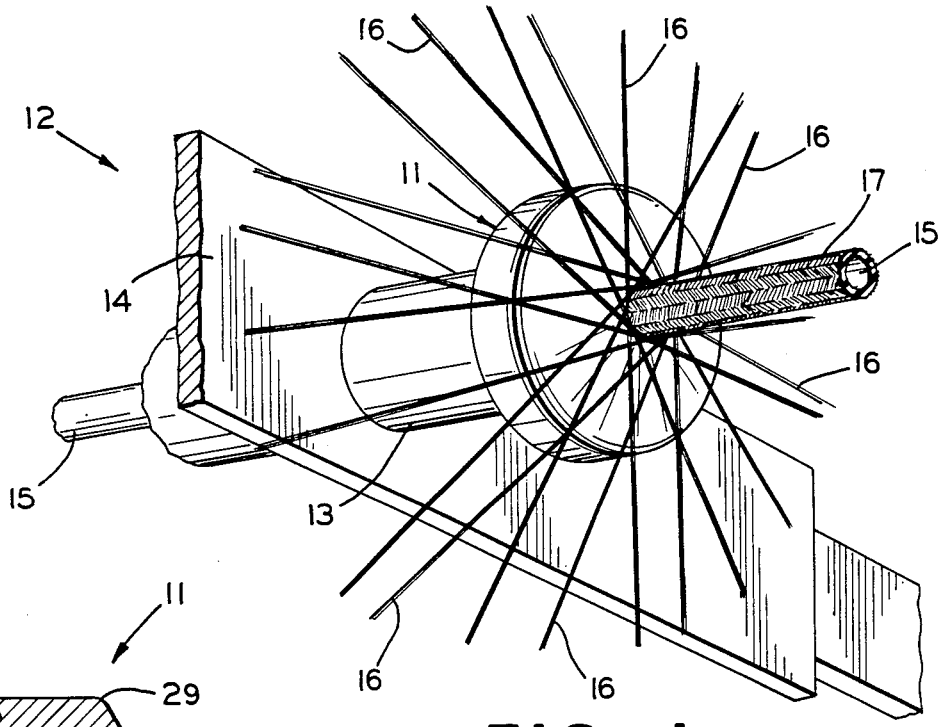
FIG. 1 is a perspective view of a portion of a braiding machine including a braiding nose in accordance with the present invention.

Referring to FIG. 1 of the drawings, a preferred embodiment of the invention involves a braiding nose 11 utilized in a braiding machine 12. The braiding nose 11 is mounted on one end of a tubular extension 13. The opposite end of the tubular extension 13 extends through and is attached to a supporting frame of the braiding machine 12. A flexible tube 15 is drawn from a supply reel (not shown) and is directed through the tubular extension 13 and an aperture formed in the braiding nose 11. A plurality of strands of wire 16 are drawn from bobbins (not shown) and directed over an outer surface of the braiding nose 11 to form a braided outer cover 17 on the exterior surface of the flexible tube 15. The braided cover 17 is continuously formed as the flexible tube 15 is drawn through the tubular extension 13 and the braiding nose 11.

Figure 2:
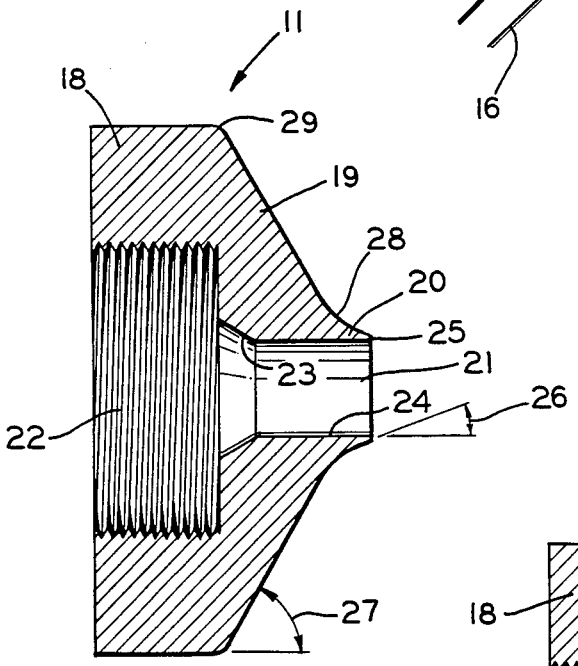
FIG. 2 is a cross-sectional view of the braiding nose of FIG. 1.
Figure 3:
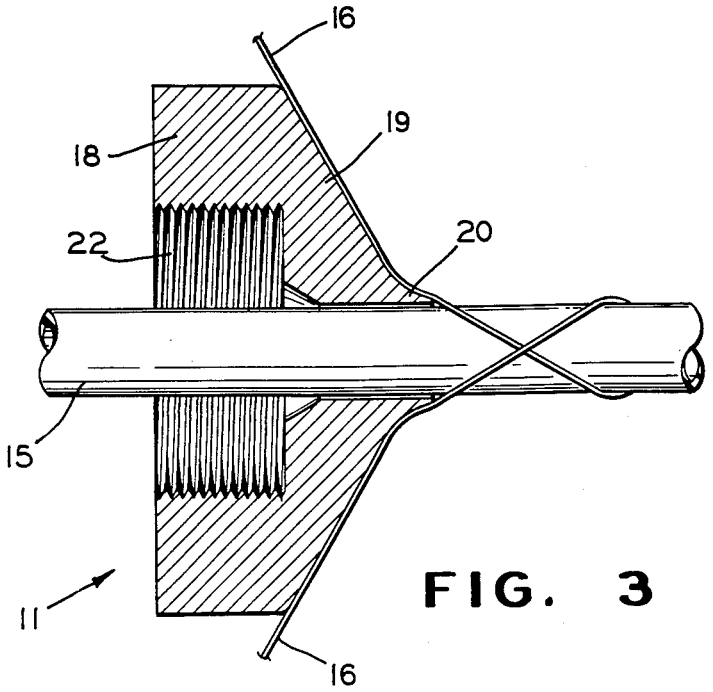
FIG. 3 is a cross-sectional view of the braiding nose of FIG. 1 illustrating the braiding operation with a tube and strands of wire.

As shown in FIGS. 2 and 3, the braiding nose 11 is formed with a generally cylindrical body portion 18 connected to a right frustum portion 19 which tapers inwardly to a tapered tip portion 20. The tip portion 20 is relatively short as compared to the portion 19. An aperture 21 is formed coaxially with the axis of the cylindrical body portion 18. An end 22 of the aperture 21 formed in the cylindrical body portion 18 has a relatively large diameter and is threaded. The threaded end 22 is adapted to treadably engage the tubular extension 13 to maintain the braiding nose 11 on the braiding machine 12. The center portion of the aperture 21 is a chamfered section 23 which tapers from a smaller diameter tip end 24 of the aperture 21 to a diameter slightly larger than the outer diameter of the tube 15 to guide the tube 15 from the extension 13 into the tip end 24.

A surface 25 is formed between the periphery of a smaller diameter end of the tip portion 20 and an edge for the opening of the smaller diameter end 24 of the aperture 21. The surface 25 lies in a plane which is generally perpendicular to the longitudinal axis of the aperture 21 and typically is approximately 0.020 inches in width. The tip portion 20 is tapered at an angle 26 with respect to the longitudinal axis of the aperture 21. The right frustum portion 19 is formed at an angle 27 with respect to the longitudinal axis of the aperture 21 and the right frustum portion 19 and the tip portion 20 are connected by a blend or radius portion 28 to eliminate any sharp angle between them. Also, a radius or blend portion 29 is formed where the cylindrical body portion 18 joins the right frustum portion 19. The radius portions 28 and 29 reduce the stress on the wire 16 and eliminate cracks or cuts which could weaken the braided cover 17.

In a typical commercial application for one fourth inch to one half inch tubing, the outer diameter of the cylindrical body portion 18 would be approximately four inches. The diameter of the threaded end 22 would be approximately two inches. The diameter of the smaller diameter end 24 would be slightly larger than the outer diameter of the flexible tube 15 and corresponds to the final wire outer diameter dimensions of the hose. The length of the tip portion must be at least the width of the wire plat at the braiding angle. For example, if six ends of a 0.015 inch wire are being braided at an angle of 54.4 degrees, the length of the tip portion 20 must be at least 0.11 inches ($6\times0.015/\sin 54.4$). For best results, the angle 26 should be in the range of fifty degrees to seventy degrees and the angle 27 should be in the range of twenty degrees to forty degrees, both angles measured with respect to a longitudinal axis of the aperture 21. A typical tension level is twenty to thirty pounds per end most of which is absorbed by the braiding nose. A braiding nose constructed as described above has been successfully utilized to produce a wire braided hydraulic hose of commercial quality without the requirement of freezing or otherwise supporting the interior flexible tube during the braiding process.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A braiding nose for forming a braided cover on a flexible hose, comprising:

a generally cylindrical body portion;

a right frustum portion extending from said body portion and tapering inwardly at a first predetermined angle defining an outer surface adapted to contact a plurality of braiding strands;

a tip portion extending from said right frustum portion and tapering inwardly at a second predetermined angle defining an outer surface adapted to contact the plurality of braiding strands; and an aperture, for receiving a flexible hose, formed through said body portion, said right frustum portion and said tip portion.

2. The braiding nose according to claim 1 wherein said aperture has threads formed in said body portion for attachment to a braiding machine.

3. The braiding nose according to claim 1 including a radius portion connecting said body portion with said right frustum portion.

4. The braiding nose according to claim 1 wherein said first predetermined angle is in a range of fifty degrees to seventy degrees with respect to a line generally parallel to a longitudinal axis of said aperture.

5. The braiding nose according to claim 1 including a radius portion connecting said right frustum portion with said tip portion.

6. The braiding nose according to claim 1 wherein said second predetermined angle is in a range of twenty degrees to forty degrees with respect to a line generally parallel to a longitudinal axis of said aperture.

7. The braiding nose according to claim 1 including a ring-shaped surface formed between an opening at one end of said aperture and a periphery of a tapered surface of said tip portion.

8. The braiding nose according to claim 7 wherein said ring-shaped surface is approximately 0.020 inches in width.

9. A braiding nose for forming a wire braided hydrulic hose, comprising:

a generally cylindrical body portion having means for attachment to a braiding machine;

a right frustum portion extending from said body portion and tapering inwardly at a first predetermined angle defining an outer surface adapted to contact a plurality of braiding strands;

a tip portion extending from said right frustum portion and tapering inwardly at a second predetermined angle defining an outer surface adapted to contact the plurality of braiding strands; and an aperture, for receiving a flexible hose, formed through said body portion, said right frustum portion and said tip portion.

10. The braiding nose according to claim 9 wherein said attachment means includes threads formed in said body portion in a larger diameter end of said aperture.

11. The braiding nose according to claim 9 wherein said aperture has a smaller diameter end formed in said right frustum portion and said tip portion, said smaller diameter end having a diameter approximately equal to an outer diameter of a wire braided hydraulic hose.

12. The braiding nose according to claim 9 wherein said tip portion has a length at least equal to the number of strands of wire to be braided times the diameter of the strands of wire divided by the sine of the angle at which the strands of wire are to be braided together.

13. A braiding nose for forming a braided wire cover on a flexible hose, comprising:

a body having a right frustum portion tapering inwardly at a first predetermined angle, and a tip portion joined to said right frustum portion by a radius portion and tapering inwardly at a second predetermined angle; and an aperture for receiving a flexible hose formed through said right frustum portion and said tip portion.

14. The braiding nose according to claim 13 wherein said first predetermined angle is in a range of fifty degrees to seventy degrees with respect to a line generally parallel to a longitudinal axis of said aperture.

15. The braiding nose according to claim 13 wherein said second predetermined angle is in a range of twenty degrees to forty degrees with respect to a line generally parallel to a longitudinal axis of said aperture.

16. The braiding nose according to claim 13 wherein said tip portion is relatively short in length in comparison to the length of said right frustum portion.

17. The braiding nose according to claim 13 including a generally cylindrical body portion joined to said right frustum portion by a radius portion.

18. The braiding nose according to claim 17 wherein said body portion includes means for attachment to a braiding machine.

* * * * *